US005106076A

United States Patent [19]

Fujita et al.

[11] Patent Number: 5,106,076

[45] Date of Patent: Apr. 21, 1992

[54] SORTER CONTROLLER

[75] Inventors: Hiroyuki Fujita, Sakai; Toshiyuki Nakade, Ibaraki; Yoshiki Yoshioka, Tsuzuki; Toshihiro Mori, Suita, all of Japan

[73] Assignee: Mita Industrial Co., Ltd., Osaka, Japan

[21] Appl. No.: 721,954

[22] Filed: Jun. 27, 1991

[30] Foreign Application Priority Data

Jul. 2, 1990 [JP] Japan ..... 2-174973

[51] Int. Cl.[5] ..... B65H 39/10

[52] U.S. Cl. ..... 271/287; 271/288; 271/294; 271/298

[58] Field of Search ..... 271/287, 288, 292, 294, 271/298, 302, 303

[56] References Cited

U.S. PATENT DOCUMENTS

| | | | |
|---|---|---|---|
| 4,361,320 | 11/1982 | Kikuchi et al. | 271/288 |
| 4,439,865 | 3/1984 | Kikuchi et al. | 271/288 |
| 4,782,363 | 11/1988 | Britt et al. | 271/287 |

FOREIGN PATENT DOCUMENTS

| | | | |
|---|---|---|---|
| 3630384 | 3/1987 | Fed. Rep. of Germany | 271/287 |
| 3255 | 1/1981 | Japan | 271/287 |
| 47759 | 3/1983 | Japan | 271/287 |
| 135061 | 8/1983 | Japan | 271/287 |
| 81360 | 4/1986 | Japan | 271/287 |
| 180677 | 7/1988 | Japan | 271/288 |
| 2-3162 | 1/1990 | Japan | 271/292 |
| 2-3163 | 1/1990 | Japan | 271/287 |

*Primary Examiner*—Robert P. Olszewski
*Assistant Examiner*—Steven M. Reiss
*Attorney, Agent, or Firm*—Beveridge, DeGrandi & Weilacher

[57] ABSTRACT

In a sorter controller in which a plurality of sheets fed from the copying machine are separately placed in a plurality of sort bins, the preset copy number is inputted by the operation of an operation panel provided on the copying machine, and a number m of groups of sheets to be placed in a sort bin is calculated by m=INT(N/n), where INT represents a function for obtaining the integer of the number in the parenthesis and N represents the number of sheets that can be placed in a sort bin. When m≧2, the sort bin in which the copied sheets are placed is changed every time n×m sheets are placed in a sort bin. According to such feature, the copied sheets of an original never be separately placed in a plurality of sort bins, and further, the available sort bins are effectively used.

4 Claims, 4 Drawing Sheets

SORTER CONTROLLER

BACKGROUND OF THE INVENTION

The present invention relates to a sorter controller for placing copied sheets of paper, discharged in sequence by the copying machine, printer, etc., into a plurality of bins.

Some sorters have, besides a plurality of sort bins for sorting and placing a plurality of copy sheets, a non-sort bin, provided separately from the sort bins, for the normal copying operation where sorting is not performed. Moreover, some copying machines have an interruption function, whereby an interruption can be applied while a large number of originals are being copied.

When the sorter having the non-sort bin is connected to the copying machine having the interruption function and the copying operation is performed in the non-sort mode, the copied sheet are sequentially placed in the non-sort bin. If the interruption is applied in the middle of the copying operation, the interrupting sheet is placed in the sort bin. In this case, if a plurality of sheets are copied as the interruption, the sort bins shifts every time each of the copied sheets are discharged.

In the interruption copying operation as described above, when the number of originals is larger than that of sort bins, the copying operation halts at the point of time when all the available sort bins are used up. It is inconvenient especially when the copy number (preset number) of an original is small (such as 1 or 2). To avoid this, a method can be considered where copied sheets as many as possible are placed in a sort bin (that is, to the number of sheets that can be placed in a sort bin) and the sort bin is shifted when it becomes full. However, in the method, the copied sheets of an original may be separated and placed in different sort bins.

SUMMARY OF THE INVENTION

An object of the present invention is to provide a sorter controller where the available sort bins are effectively utilized and the copied sheets (or printed-out sheets when the sorter controller is employed for a printer) are easily arranged after the copying operation.

According to one feature of the present invention, the sorter controller comprises: preset number inputting means for inputting a number n of a group of sheets fed from outside machinery such as the copying machine, etc.; calculating means for calculating a number m of groups of sheets to be placed in a sort bin by the following equation:

$$m = \mathrm{INT}(N/n)$$

(where INT represents a function for obtaining the integer in the parenthesis, and N represents the number of sheets that can be placed in a sort bin); and sort bin changing means for changing sort bins every time $n \times m$ sheets of paper is placed in a bin when $m \geqq 2$.

According to such feature, a group of sheets (in the above example, copied sheets of an original) never be separately placed in a plurality of sort bins, since the sort bin changing means change sort bins every time $n \times m$ sheets of paper is placed. Further, the available sor bins are effectively utilized since the copied sheets are placed in a sort bin to the limit. As a result, the copied paper are easily arranged after copying operation.

BRIEF DESCRIPTION OF THE DRAWING

This and other objects and features of this invention will become clear from the following description taken in conjunction with the preferred embodiments with reference to the accompanied drawings in which.

DETAILED DESCRIPTION OF THE PREFERRED EMBODIMENTS

Figure 4:
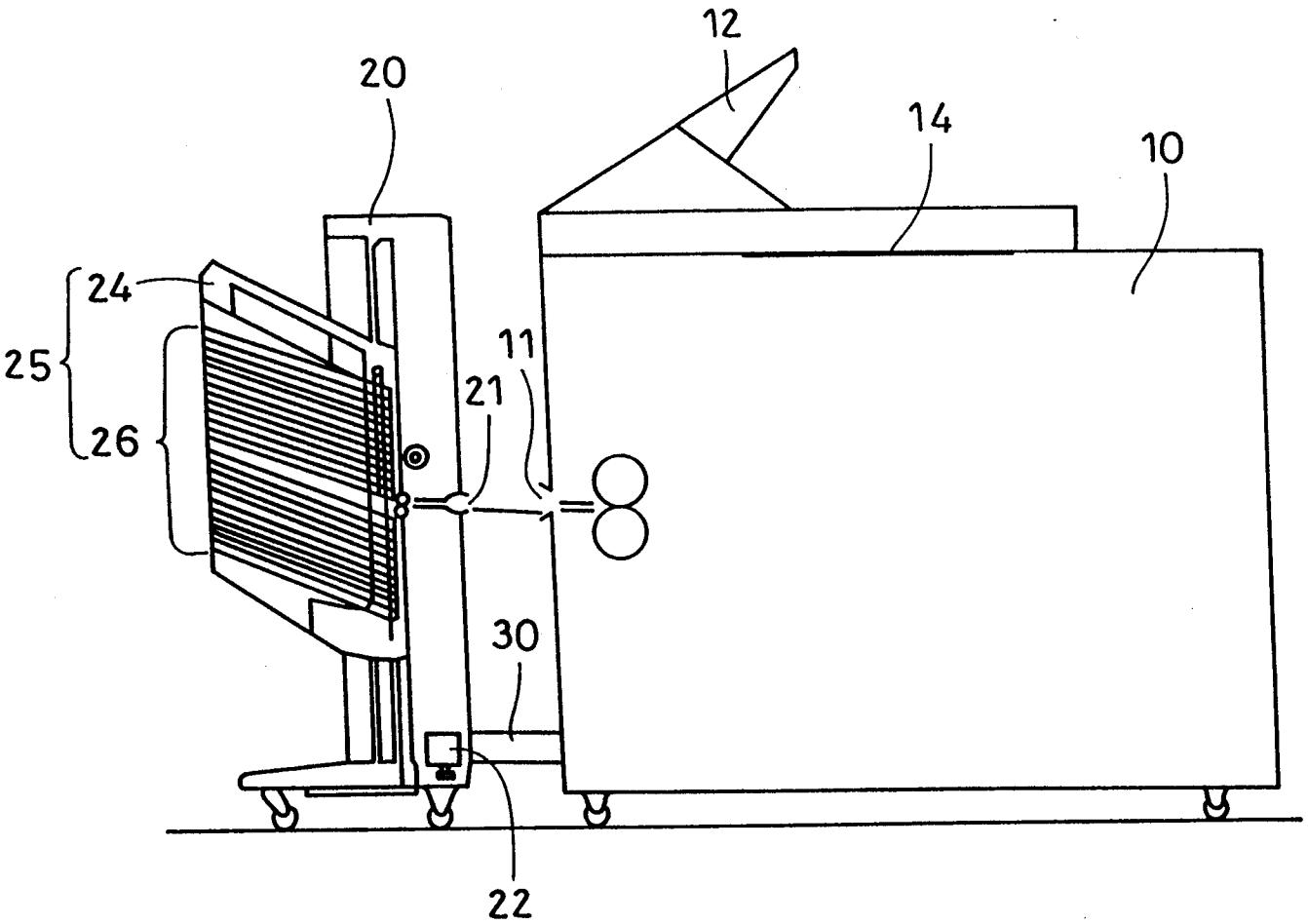
FIG. 4 is a side view of a copying machine to which a sorter as an embodiment of the present invention is connected.

FIG. 4 is a side view of a copying machine 10 to which a sorter 20 as an embodiment of the present invention is applied. In the copying machine 10, which has an automatic document feeder (hereinafter referred to as ADF) 12, a plurality of originals are automatically sent onto a contact glass in sequence. An operation panel 14 is provided on the upper surface of the copying machine. When the sorter 20 is connected to the copying machine 10, the operation modes of the sorter 20 can also be set by operating the operation panel 14 of the copying machine 10. A coped sheet is discharged from a discharge slit 11.

The sorter 20 has a non-sort bin 24 and a plurality of sort bins 26. The sorter 20 is of sort bin shifting type, where all the sort bins shift upward and downward as a unit 25. When the sort bin in which copied sheets are placed is changed, the unit 25 shifts upward or downward. A copied sheet is sent to the sorter 20 through a receiving slit 21. The sorter 20 has a controller 22 consisting of a microcomputer. The controller 22 exchanges data with a controller (not shown) of the copying machine 10 through a control line laid through a connecting bridge 30.

With respect to the above-described copying device, a case will be considered where a plurality of originals are copied by a plurality of numbers as the interruption in the middle of a copying operation in a non-sort mode. When a copying operation is performed in the non-sort mode, all the copied sheets are placed in the non-sort bin 24. In the middle of the above operation, an interruption key provided on the operation panel 14 is pushed, originals are placed on the ADF 12, and the copy number (preset number) NP is inputted. Then, the inputted data is transmitted to the controller 22 of the sorter 20 through the controller of the copying machine 10, so that the controller 22 of the sorter 20 executes a first and second routines shown in FIGS. 1 and 2, respectively.

Figure 1:
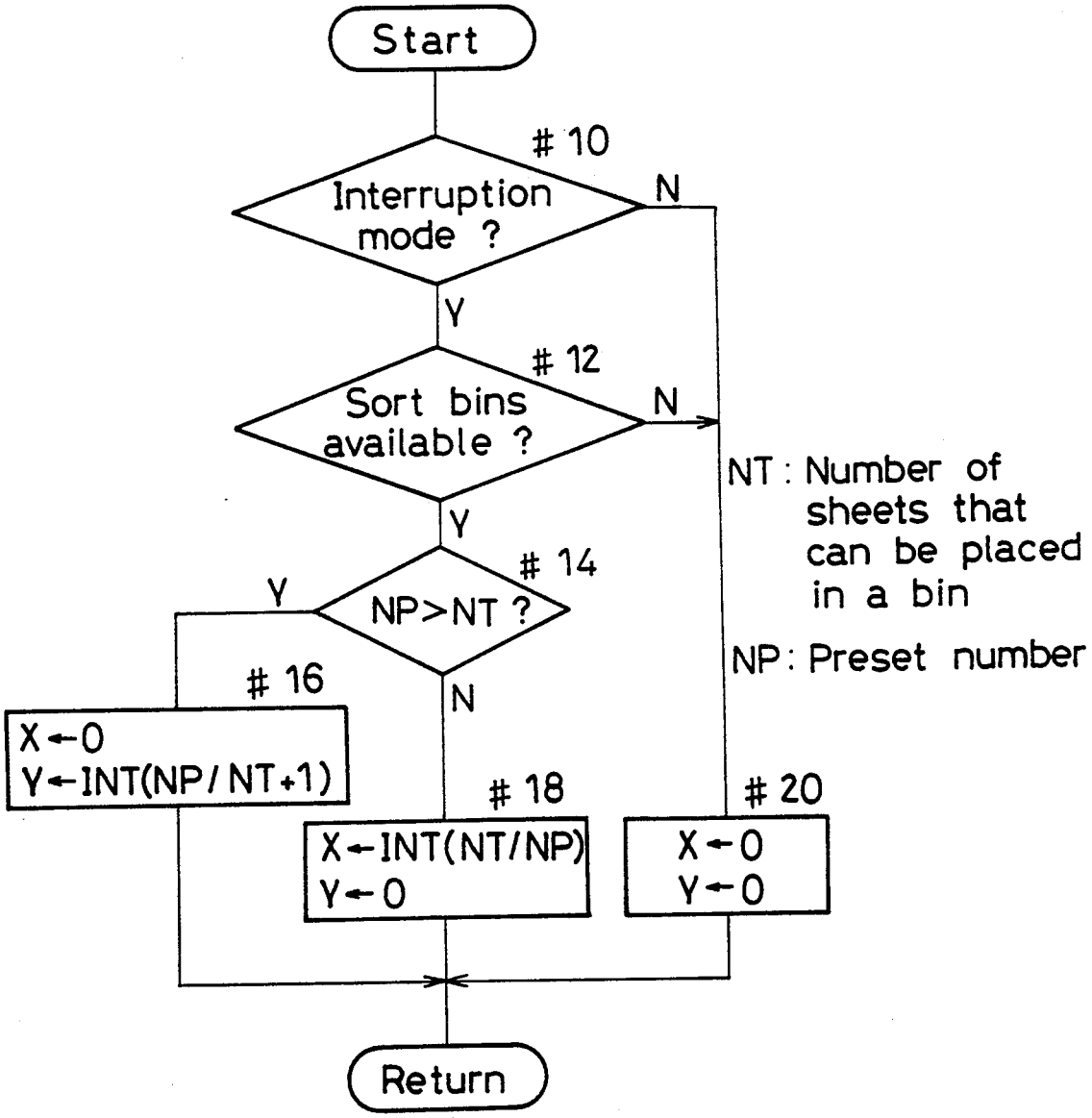
FIG. 1 is a flow chart of a first routine executed by the sorter controller as an embodiment of the present invention.

Firstly, the first routine shown in FIG. 1 is executed. At step #10, whether or not the copying machine 10 has been in an interruption mode is detected. When it has not been in the interruption mode, the process proceeds to step #20, where 0 is substituted for variables X and Y (to be described later). When it has been in the interruption mode, whether or not the sort bins 26 are available is detected at step #12. The sort bins 26 are used before an interruption is applied. When the sort bins 26 are not available, 0 is subsitituted for the variables X and Y at step #20. When the copying machine has been in the interruption mode and the sort bins 26 are available, whether or not the inputted preset number NP exceeds the number NT of copied sheets that can be placed in a sort bin is detected at step #14.

When the preset number NP exceeds the limit number NT, 0 is substituted for the variable X and the following value is substituted for the variable Y at step #16:

$$Y=\mathrm{INT}(NP/NT+1).$$

In the above equation, INT represents a function for obtaining the integer of the number in the parenthesis. Therefore, for the variable Y, the integral part, of [the copy number of an original]/[the number of sheets that can be placed in a sort bin], +1 is substituted. That is, the variable Y represents how many sort bins a group of copied sheets of an original are placed in.

When the preset number NP does not exceed the limit number NT, the following value is substituted for the variable X at step #18:

$$X=\mathrm{INT}(NT/NP).$$

That is, for the variable X, the integral part of [the number of sheets that can be placed in a sort bin]/[the copy number of an original] is substituted. X represents the number of groups (the number of originals) that can be placed in a sort bin. 0 is substituted for the variable Y.

Setting the variables X and Y according to each situtation as described above, the first routine is finished.

Figure 2:
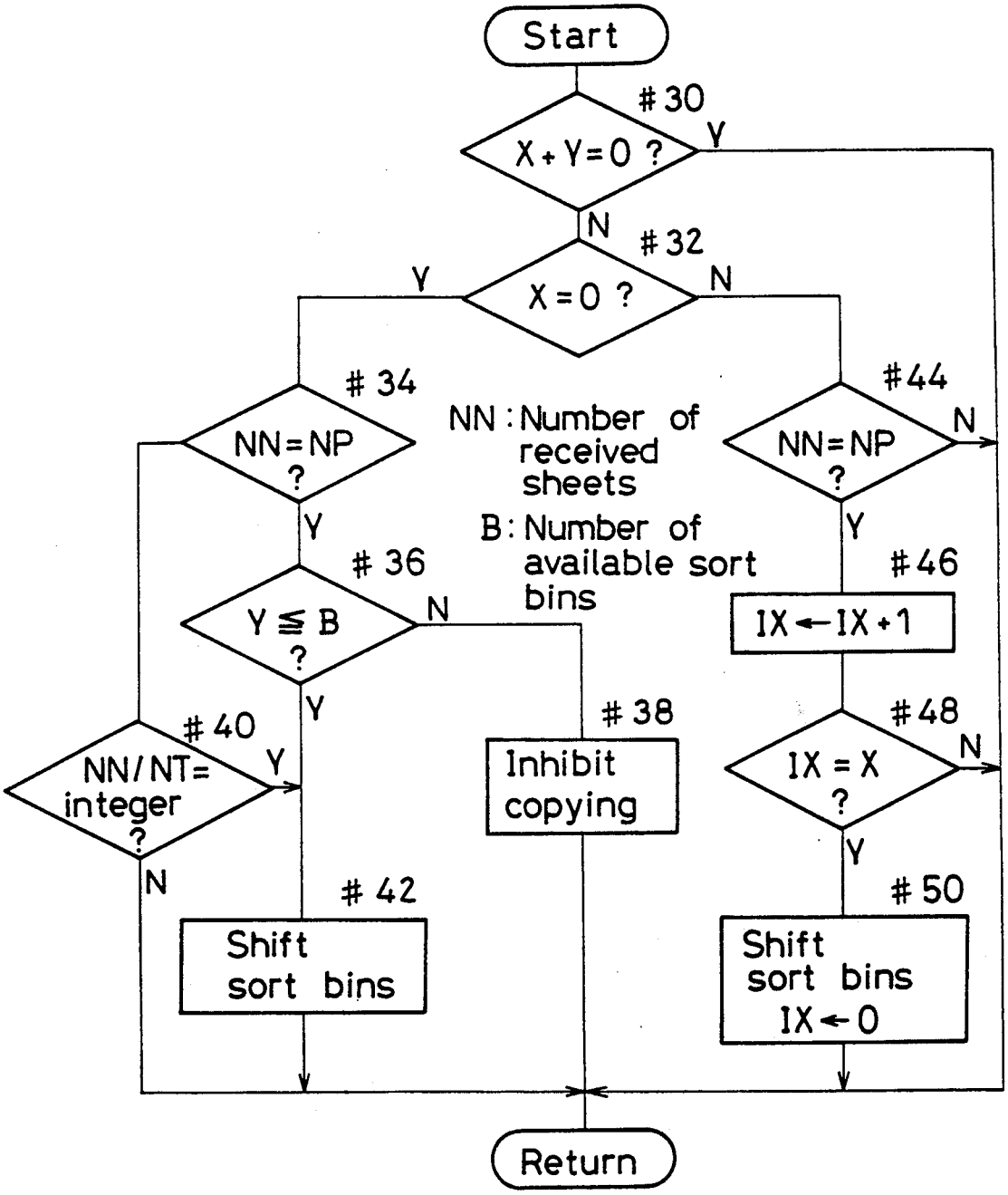
FIG. 2 is a flow chart of a second routine executed by the sorter controller as an embodiment of the present invention.

The second routine shown in FIG. 2 is executed every time the sorter 20 receives a sheet of paper from the copying machine 10. Firstly, whether $X+Y=0$ or not is detected at step #30. Since both the variables X and Y are 0 or positive integers as described above, $X+Y=0$ means that $X=0$ and $Y=0$. In this case (that is, the case where the copying machine 10 has not been in the interruption mode or the case where the sort bins 26 are not available in the first routine shown in FIG. 1), the second routine is finished with no processes being performed. In this case, another proper routine (not shown) is executed.

When $X+Y\neq 0$, whether $X=0$ or not is detected at step #32. When $X=0$ (that is, when the copy number NP of an original exceeds the limit number NT in the first routine shown in FIG. 1, the process proceeds to steps from #34, where the copied sheets received by the sorter 20 are placed in each bin in the following procedure:

(i) The case where the copy number NP of an original exceeds the number NT of sheets that can be placed in a sort bin.

At step #34, whether or not a present received number NN has reached the preset number NP (the preset number of copied sheets of an original) is detected. When it has not reached the NP, at step #40, whether or not [the present received number]/[the number of sheets that can be placed in a sort bin] is an integer is detected. When it is not an integer, the present routine (second routine) is finished to receive the next copied sheet. However, when the result of the calculation at step #40 is an integer (that is, when each sort bin is filled to the limited), the sort bins are shifted at step #42.

Figure 3A:
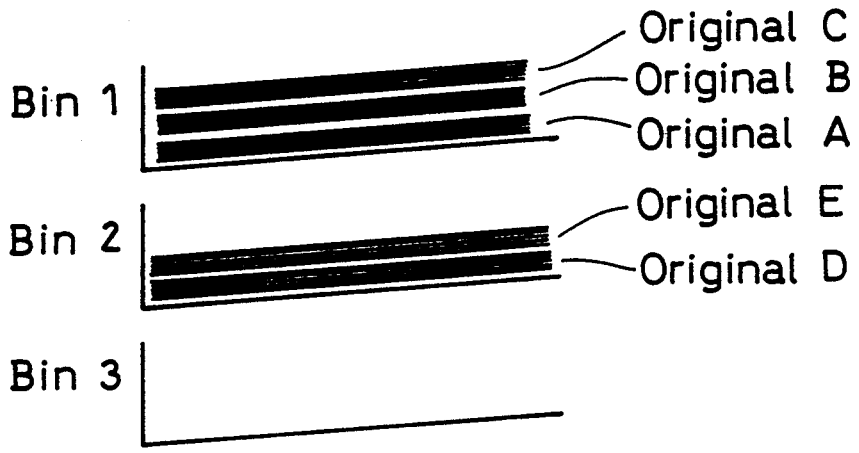
FIGS. 3A and 3B show the way how the copied sheets are placed in each sort bin in an embodiment of the present invention.
Figure 3B:
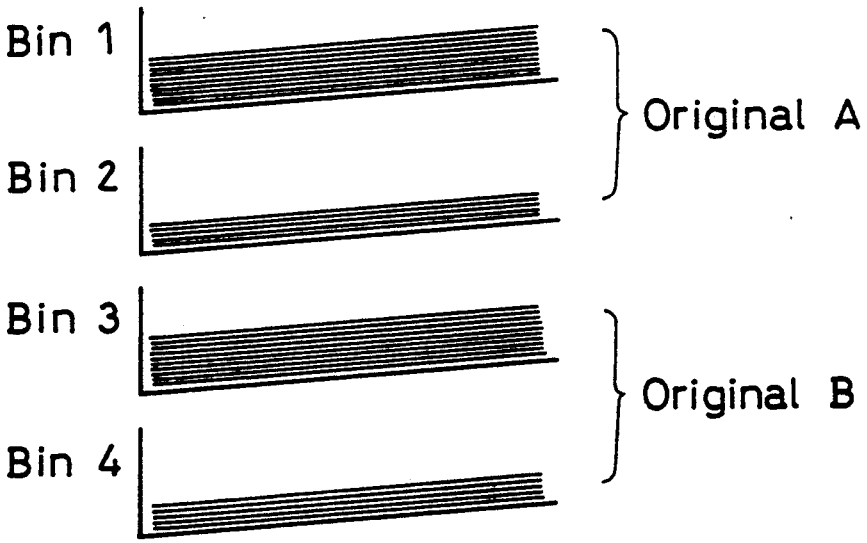

When the received number NN reaches the preset number NP, the process proceeds to step #36, where whether or not the variable Y is smaller than the number B of empty sort bins. When there are enough empty sort bins (that is, $Y\leqq B$), the sort bins are shifted at step #42. Thereby, the sort bins are shifted when the copying operation of an original to the preset number is finished, which prevents the copied sheets of a plurality of originals from being placed in a sort bin (see FIG. 3B). When it is detected that the number Y of sort bins required for placing the next preset number of sheets exceeds the number B of empty bins at step #36, a copy inhibiting signal is sent to the copying machine 10 at step #38 to automatically stop the operation of the copying machine 10.

When $X\neq 0$, that is $Y=0$, is detected is step #32, the processes from step #44 is executed.

(ii) The case where the copy number NP of an original is equal to or less than the number NT of sheets that can be placed in a sort bin.

At step #44, similar to at step #34, whether or not the present received number NN has reached the preset number NP is detected. When it has not reached the NP, the present routine (second routine) is finished to receive the next copied sheet. When the received number NN reaches the preset number NP, the process proceeds to step #46, where a counter variable IX is advanced by one (the counter variable IX is reset to 0 at the time of interruption). Then, at step #48, whether or not the counter variable IX is equal to the variable X is detected. When IX has not yet reached the number X of groups (the number of originals) that can be placed in a sort bin, the next copied sheet is received. When the IX reaches the X, the sort bins are shifted at step #50 (simultaneously, the counter variable IX is reset to 0), and the suceeding copied sheets are placed in another sort bin. Thereby, a group of copied sheets are prevented from being separately placed in a plurality of sort bins as well as the number as much as possible of groups of copied sheets are placed in a sort bin (see FIG. 3A).

In the above-described embodiment, the non-sort bin 24 is used. The present invention can also be applied to the case where, when a part of the sort bins 26 are being used, the remaining empty sort bins are used for the interruption. The present invention produces the above-described effect not only at the time of interruption but also when a plurality or originals are continuously copied in the normal mode.

Obviously, many modifications and variations of the present invention are possible in light of the above teachings. It is therefore to be understood that within the scope of the appended claims, the invention may be practiced other than as specifically described.

What is claimed is:

1. A sorter controller in which a plurality of sheets fed from outside machinery are separately placed in a plurality of sort bins comprising:

preset number inputting means for inputting a number n of a group of sheets fed from outside machinery;

calculating means for calculating a number m of groups of sheets to be placed in a sort bin by the following equation:

$$m=\mathrm{INT}(N/n)$$

where INT represents a function for obtaining the integer in the parenthesis and N represents the number of sheets that can be placed in a sort bin; and sort bin changing means for changing sort bins every time $n \times m$ sheets of paper is placed in a bin when $m \geqq 2$.

2. A sorter controller as claimed in claim 1, wherein said sorter controller is connected to a controller of said outside machinery so as to exchange signals, and said number n is given to said sorter controller through said controller of said outside machinery.

3. A sorter controller as claimed in claim 1, wherein said outside machinery is the copying machine.

4. A sorter controller in which a plurality of sheets fed from outside machinery are separately placed in a plurality of sort bins comprising:

preset number inputting means for inputting a number n of a group of sheets fed from said outside machinery;

first calculating means for calculating a number m of groups of sheets to be placed in a sort bin by the following equation:

$$m = \mathrm{INT}(N/n),$$

where INT represents a function for obtaining the integer in the parenthesis and N represents the number of sheets that can be placed in a sort bin;

second calculating means for calculating a value Q representing how many sort bins a group of sheets is placed in by the following equation:

$$Q = \mathrm{INT}(n/N + 1); \text{ and}$$

sort bin changing means for changing sort bins every time $n \times m$ sheets of paper is placed in a sort bin when $m \geqq 2$ and when $Q \geqq 2$, for changing sort bins every time N sheets of paper is placed in a sort bin.

* * * * *